US010452093B2

(12) United States Patent
Lawson

(10) Patent No.: US 10,452,093 B2
(45) Date of Patent: Oct. 22, 2019

(54) AUTOMATIC LOCKING KNOB ASSEMBLIES AND METHODS OF USE

(71) Applicant: Trevor Lawson, Beverly, MA (US)

(72) Inventor: Trevor Lawson, Beverly, MA (US)

(73) Assignee: RangeSafe, LLC, Bracey, VA (US)

( * ) Notice: Subject to any disclaimer, the term of this patent is extended or adjusted under 35 U.S.C. 154(b) by 0 days.

(21) Appl. No.: 15/618,028

(22) Filed: Jun. 8, 2017

(65) Prior Publication Data

US 2017/0336824 A1 Nov. 23, 2017

Related U.S. Application Data

(63) Continuation of application No. 14/746,650, filed on Jun. 22, 2015, now Pat. No. 9,684,329.

(60) Provisional application No. 62/015,485, filed on Jun. 22, 2014, provisional application No. 62/089,762, filed on Dec. 9, 2014.

(51) Int. Cl.

| | |
|---|---|
| ***G05G 1/10*** | (2006.01) |
| ***G05G 5/06*** | (2006.01) |
| ***G05G 1/08*** | (2006.01) |
| ***G05G 5/00*** | (2006.01) |

(52) U.S. Cl.

CPC ..... *G05G 1/082* (2013.01); *G05G 5/005* (2013.01); *G05G 5/06* (2013.01); *G05G 1/10* (2013.01); *Y10T 74/2084* (2015.01)

(58) Field of Classification Search

CPC ..... G05G 1/08; G05G 1/082; G05G 1/10; G05G 1/12; G05G 5/005; G05G 5/04; G05G 5/06; H01H 3/08; H01H 3/10; H01H 19/003; H01H 19/11; H01H 19/14; Y10T 74/2084

See application file for complete search history.

(56) References Cited

U.S. PATENT DOCUMENTS

| | | | | |
|---|---|---|---|---|
| 2,829,538 A | | 4/1958 | Mueller | |
| 2,849,891 A | | 9/1958 | Mills | |
| 3,158,034 A | * | 11/1964 | Williamson | G05G 1/08 100/918 |
| 3,427,680 A | | 2/1969 | Gilbert | |
| 4,253,690 A | | 3/1981 | Hollander | |
| 4,300,525 A | | 11/1981 | Delgado et al. | |
| 5,363,720 A | | 11/1994 | Sanchez | |
| 5,741,003 A | | 4/1998 | Segien, Jr. | |
| 5,771,878 A | | 6/1998 | Lewis et al. | |
| 5,931,150 A | | 8/1999 | Bowen et al. | |
| 6,375,150 B1 | | 4/2002 | Aguirre-Esponda et al. | |
| 6,394,081 B1 | | 5/2002 | Aguirre-Esponda et al. | |

(Continued)

FOREIGN PATENT DOCUMENTS

| | | | | |
|---|---|---|---|---|
| EP | 2624095 A1 | * | 8/2013 | G05G 1/08 |
| FR | 2612331 A1 | | 9/1988 | |

(Continued)

*Primary Examiner* — Adam D Rogers

(74) *Attorney, Agent, or Firm* — Carr & Ferrell LLP

(57) ABSTRACT

Embodiments of the present technology relate to safety knobs. An example automatic locking knob assembly includes a knob, a base, an adapter, and a locking sub-assembly. The locking sub-assembly is configured to automatically lock the knob into place when a valve stem of a stove is in an off position. The locking sub-assembly also allows for controlled rotation of the valve stem of the stove by actuation of buttons associated with the knob.

17 Claims, 12 Drawing Sheets

(56) References Cited

U.S. PATENT DOCUMENTS

| | | | | |
|---|---|---|---|---|
| 7,745,749 | B2 | 6/2010 | Ito | |
| 7,922,342 | B2 | 4/2011 | Okada | |
| 8,434,199 | B1 | 5/2013 | Bowen et al. | |
| 8,944,404 | B2 | 2/2015 | Giacomini | |
| 8,967,019 | B2 | 3/2015 | O'Keefe et al. | |
| 9,182,773 | B2 | 11/2015 | Campean | |
| 9,268,356 | B2 | 2/2016 | Burleson | |
| 9,684,329 | B2 | 6/2017 | Lawson | |
| 10,051,996 | B2 * | 8/2018 | Starr ..... | A47J 37/0629 |
| 2015/0370283 | A1 | 12/2015 | Lawson | |
| 2016/0209863 | A1 | 7/2016 | Stringos | |

FOREIGN PATENT DOCUMENTS

| | | | |
|---|---|---|---|
| GB | 2253898 | A | 9/1992 |
| WO | WO2015180789 | A1 | 12/2015 |

* cited by examiner

AUTOMATIC LOCKING KNOB ASSEMBLIES AND METHODS OF USE

CROSS REFERENCE TO RELATED APPLICATIONS

This Non-Provisional U.S. Patent Application is a continuation of, and claims priority benefit of, Non-Provisional U.S. patent application Ser. No. 14/746,650, filed Jun. 22, 2015, which claims the priority benefit of U.S. Provisional Application Ser. No. 62/015,485, filed on Jun. 22, 2014; and U.S. Provisional Application Ser. No. 62/089,762, filed on Dec. 9, 2014, which are all hereby incorporated by reference herein in their entireties, including all references cited therein.

FIELD OF THE PRESENT TECHNOLOGY

The present technology relates generally to safety knobs and, more particularly, but not by limitation, to automatic locking knob assemblies for use on stoves and other similar appliances that comprise knobs.

SUMMARY

Embodiments of the present technology include an automatic locking knob assembly, comprising: (a) a knob; (b) a base configured to mount to a stove surface of a stove, the base comprising two pillars disposed in spaced apart relationship to one another, a first of the two pillars comprising a first groove and a second of the two pillars comprising a second groove; (c) an adapter configured to mate with a valve stem of the stove extending through the base; and (d) a locking sub-assembly, comprising: (i) a first button comprising a first leg; (ii) a second button comprising a second leg, the first leg and the second leg being resiliently coupled to one another, the first button and the second button extending at least partially from the knob; (iii) the first leg and the second leg being configured to fit within one of the first groove and the second groove to place the knob in a locked position; and (iv) wherein simultaneous depression of the first and second button cause the first leg and the second leg to disassociate with the first groove and the second groove allowing the knob to freely rotate as well as the first and second legs to contact the adapter and turn the valve stem.

Other embodiments of the present technology include an automatic locking knob assembly, comprising: (a) a knob; (b) a base configured to mount to a stove surface of a stove, the base comprising a sidewall that comprises at least one slot; (c) an adapter configured to mate with a valve stem of the stove extending through the base; and (d) a locking sub-assembly, comprising: (i) at least one button comprising at least one leg, the at least one button extending at least partially from the knob; (ii) the at least one leg being configured to mate with the at least one slot to place the knob in a locked position, wherein the knob is in the locked position the valve stem is in an off position; and (iii) wherein depression of the at least one button causes the at least one leg and a second leg to disassociate with the slots allowing the knob to freely rotate as well as the at least one leg and the second leg to contact the adapter and turn the valve stem.

Other embodiments of the present technology include an automatic locking knob assembly, comprising: (a) a knob; (b) a base configured to mount to a stove surface of a stove, the base comprising two pillars disposed in spaced apart relationship to one another, a first of the two pillars comprising a first groove and a second of the two pillars comprising a second groove; (c) an adapter configured to mate with a valve stem of the stove extending through the base; and (d) a locking sub-assembly, comprising: (i) a first button comprising a first leg; (ii) a second button comprising a second leg, the first leg and the second leg being resiliently coupled to one another with a spring, the first button and the second button extending at least partially from the knob; (iii) the first leg and the second leg being configured to fit within one of the first groove and the second groove to place the knob in a locked position; (iv) wherein simultaneous depression of the first and second button cause the first leg and the second leg to disassociate with the first groove and the second groove allowing the knob to freely rotate as well as the first and second legs to contact the adapter and turn the valve stem; (v) a first strut extending between the first button and the second button, wherein the first strut is rotationally supported on a central shaft aligned with a central axis of the assembly; and (vi) a second strut extending between the first button and the second button, wherein the second strut is rotationally supported on the central shaft, wherein simultaneous depression of the first and second buttons causes the first and second struts to rotate about the central axis.

DETAILED DESCRIPTION

Figure 1:
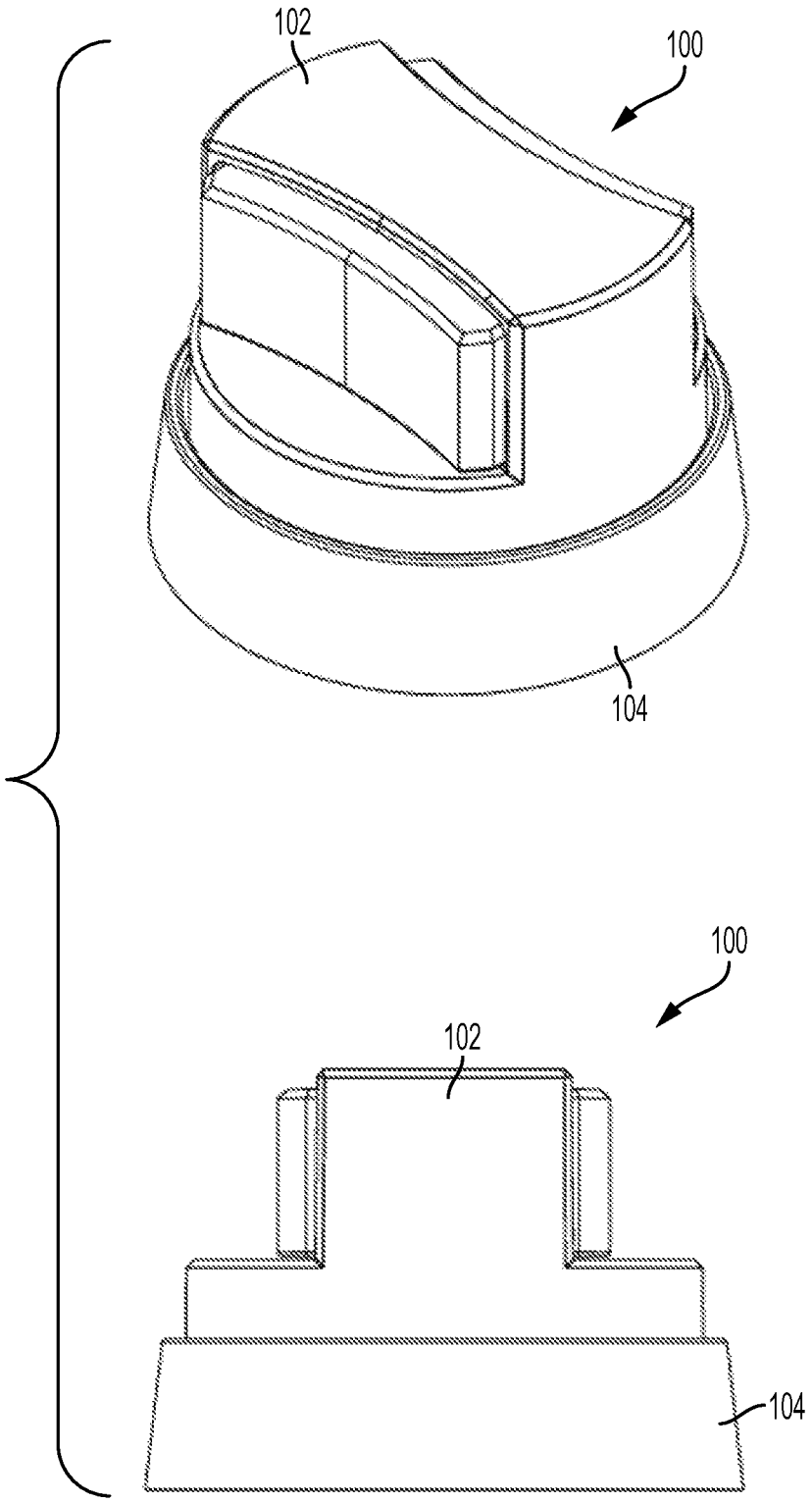
FIG. 1 illustrates both a perspective view of an example automatic locking knob assembly as well as front elevation view of the automatic locking knob assembly.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry may be interchangeably used with its non-capitalized version, a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In general, the present technology is directed to safety knobs that automatically lock when in the "off" position. To be clear, an "off" position as referred to herein should be understood to include a state of position of a power or fuel source for a stove. For example, a valve stem that controls emission of gas in a gas stovetop would be "off" when no gas is flowing through the gas burner on the stove. This is typically accomplished by placing a temperature knob in an "off" position. The "off" position of the temperature knob is aligned with the "off" position of the valve stem of the gas burner. A similar configuration exists for an electric burner with the exception that the temperature knob is not coupled to a valve stem but a potentiometer or thermostat. An "off" position of the temperature knob corresponds to an "off" position for the electric burner, meaning that no electricity is flowing to the electric burner.

The present technology advantageously provides an automatic locking feature for the knob that prevents unintentional movement of the knob away from its "off" position. These and other advantages of the present technology will be described in greater detail below.

FIG. 1 illustrates an automatic locking knob assembly 100 of the present technology (referred to herein as "assembly 100"). The assembly 100 generally comprises a knob 102, a base 104, an adapter 106 (FIG. 2), and a locking sub-assembly 108 (FIG. 2).

Figure 2:
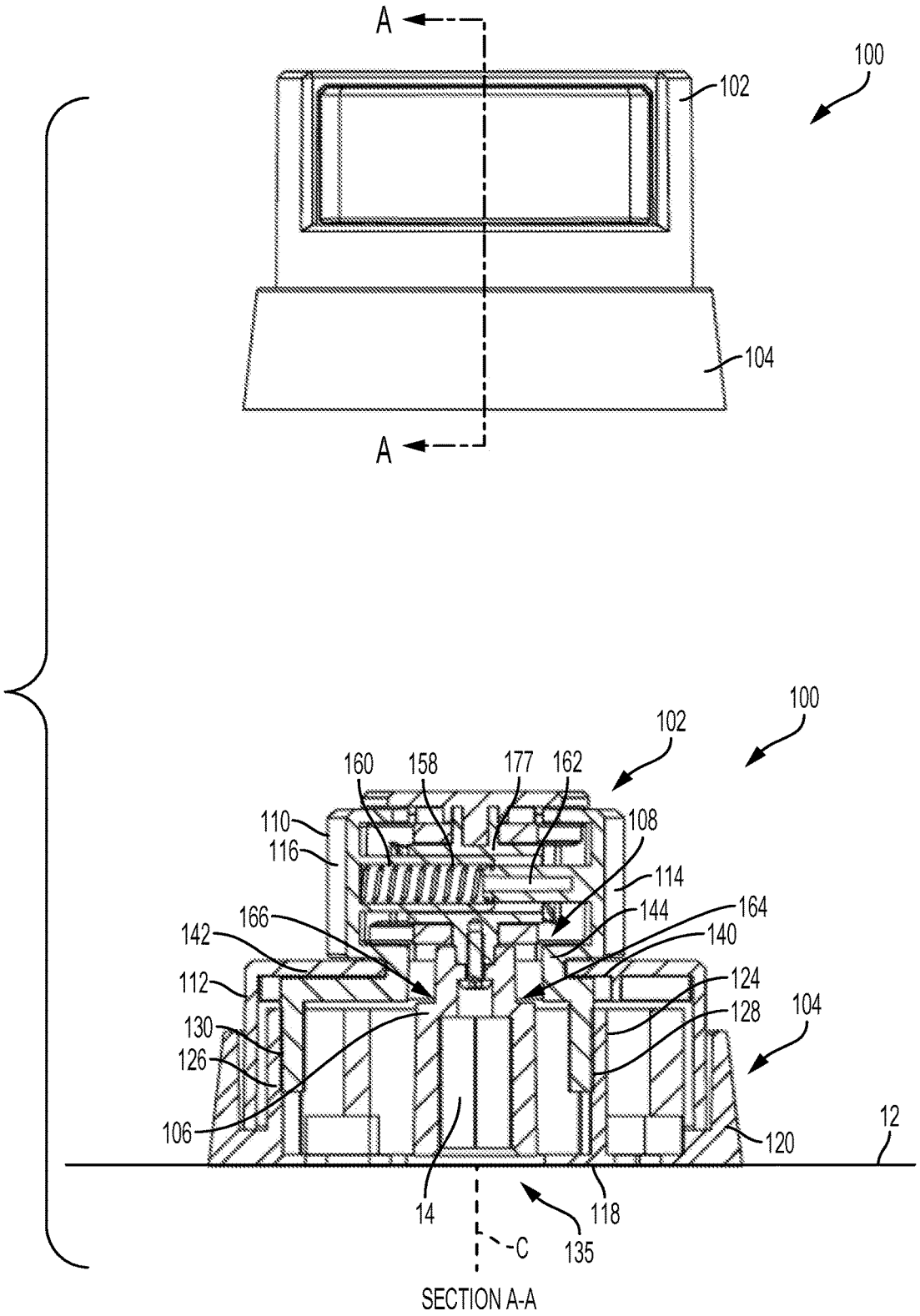
FIG. 2 illustrates a cross sectional view of the automatic locking knob assembly of FIG. 1 taken along section line A-A. The automatic locking knob assembly is in combination with an adapter and valve stem of a stove.

FIG. 2 includes a detailed section view A-A, which illustrates additional components of the assembly 100. In general, the assembly 100 can be constructed from any variety of materials such as plastics, resins, polymers, metals, alloys, composite materials, natural materials, and any combinations thereof.

In some embodiments, the knob 102 comprises a cap that is configured to be received within the base 104. In some embodiments the knob 102 comprises a housing portion 110 that surrounds at least a portion of the locking sub-assembly 108. The knob 102 also includes a collar portion 112 that is configured to be easily grasped by an end user. The collar portion 112 is configured to allow a pair of buttons, such as first button 114 and second button 116 (each part of the locking sub-assembly 108) to protrude therefrom. For example, buttons 114 and 116 extend from opposing sides of the collar portion 112 such that an end user can depress the buttons and grip the collar portion 112 with one hand.

Figure 3:
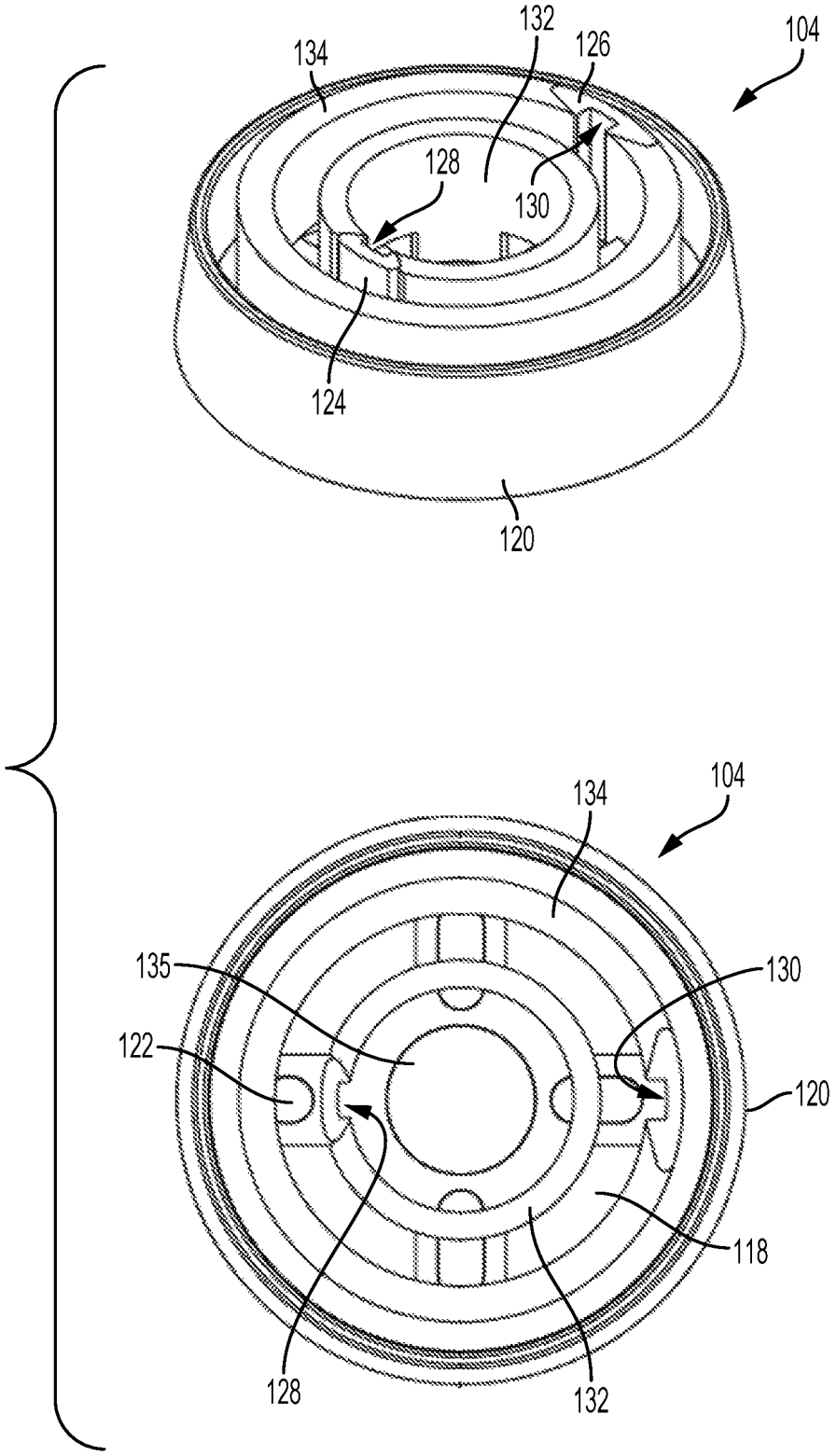
FIG. 3 illustrates both a perspective view of a base as well as a top down view of the base.
Figure 4:
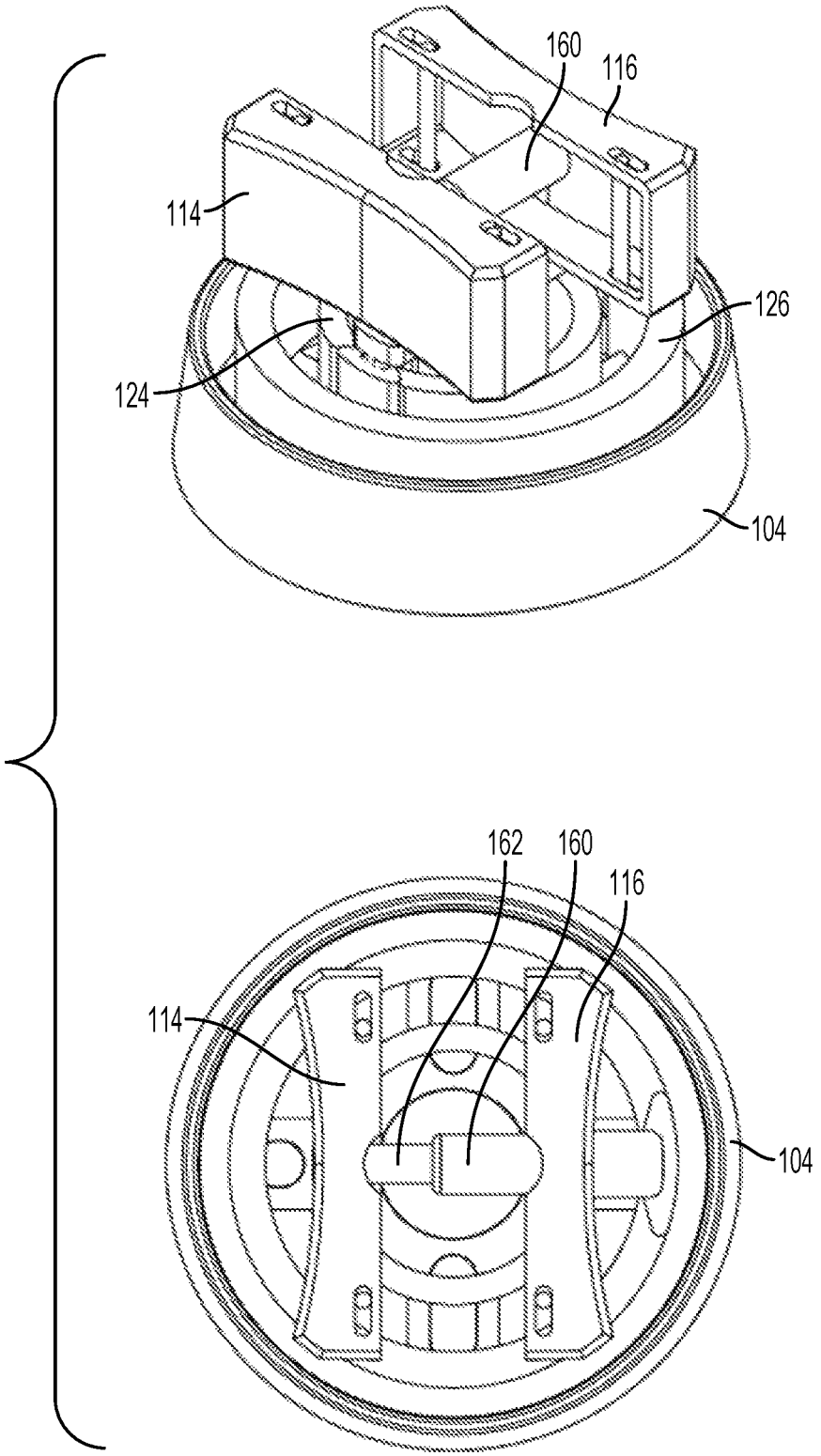
FIG. 4 illustrates both a partial perspective view of the automatic locking knob assembly as well as a top down partial view of the automatic locking knob assembly with the knob removed.

Referring now to FIGS. 2-4 collectively, the base 104 can be configured to mount to a stove surface 12 of a stove. The base 104 can comprise a disk portion 118 and an outer peripheral sidewall 120 that bounds the disk portion 118. The disk portion 118 is provided with apertures, such as aperture 122 that receives a fastener such as a screw for securing the base 104 to the stove surface 12. As placement of the apertures can be arraged on the disk portion 118 to ensure that the base 104 is placed properly to facilitate alignment of the knob 102 in a locked position, as will be discussed in greater detail infra.

In some embodiments, the housing portion 110 of the knob 102 is sized to fit within the outer peripheral sidewall 120 in such a way that the knob 102 can freely rotate relative to the base 104, as illustrated in FIGS. 1 and 2.

In some embodiments, the base 104 can comprise a first pillar 124 and a second pillar 126. These pillars are disposed in spaced apart relationship with one another and extend normally from the disk portion 118 of the base 104. In some embodiments, the first pillar 124 includes a first groove 128 and the second pillar 126 comprises a second groove 130.

In one embodiment, the base 104 comprises a first track sidewall 132 that is integrated along with the first pillar 124. The base 104 can also comprise a second track sidewall 134 that is integrated with the second pillar 126. The first track sidewall 132 sits within the second track sidewall 134 such that the first track sidewall 132 and the second track sidewall 134 form concentric circles. Also, the second track sidewall 134 sits within the outer peripheral sidewall 120 of the base 104.

In some embodiments, the base 104 comprises a central aperture 135 that receives the valve stem 14 of the stove 12.

The adapter 106 is configured to mate with a valve stem 14 of the stove 12 extending through the base 104. Various embodiments of adapters will be described herein although generally the adapter 106 is provided to indirectly couple the locking sub-assembly 108 with the valve stem 14. The adapter 106 is configured to couple with the valve stem 14 in such a way that when the adapter 106 is rotated the valve stem 14 rotates correspondingly. It will be understood that the adapter 106 can be configured to mate with any number of valve stems of varying size and shape.

It will be understood that some embodiments of the present technology operate by placing lateral forces on the valve stem 14 to grip the valve stem 14 when the buttons 114 and 116 are depressed. The locking sub-assembly 108 operates by placing lateral forces on the valve stem 14 when the user desires to rotate the knob 102 to an "on" or operational position. The user depresses the buttons 114 and 116, which causes the locking sub-assembly 108 to grip or capture the valve stem 14. To be sure, most valve stems of stoves are substantially circular in shape which complicates attempts to place forces laterally onto the valve stem. Additional details regarding these lateral forces will be described with respect to the locking sub-assembly 108.

Figure 5:
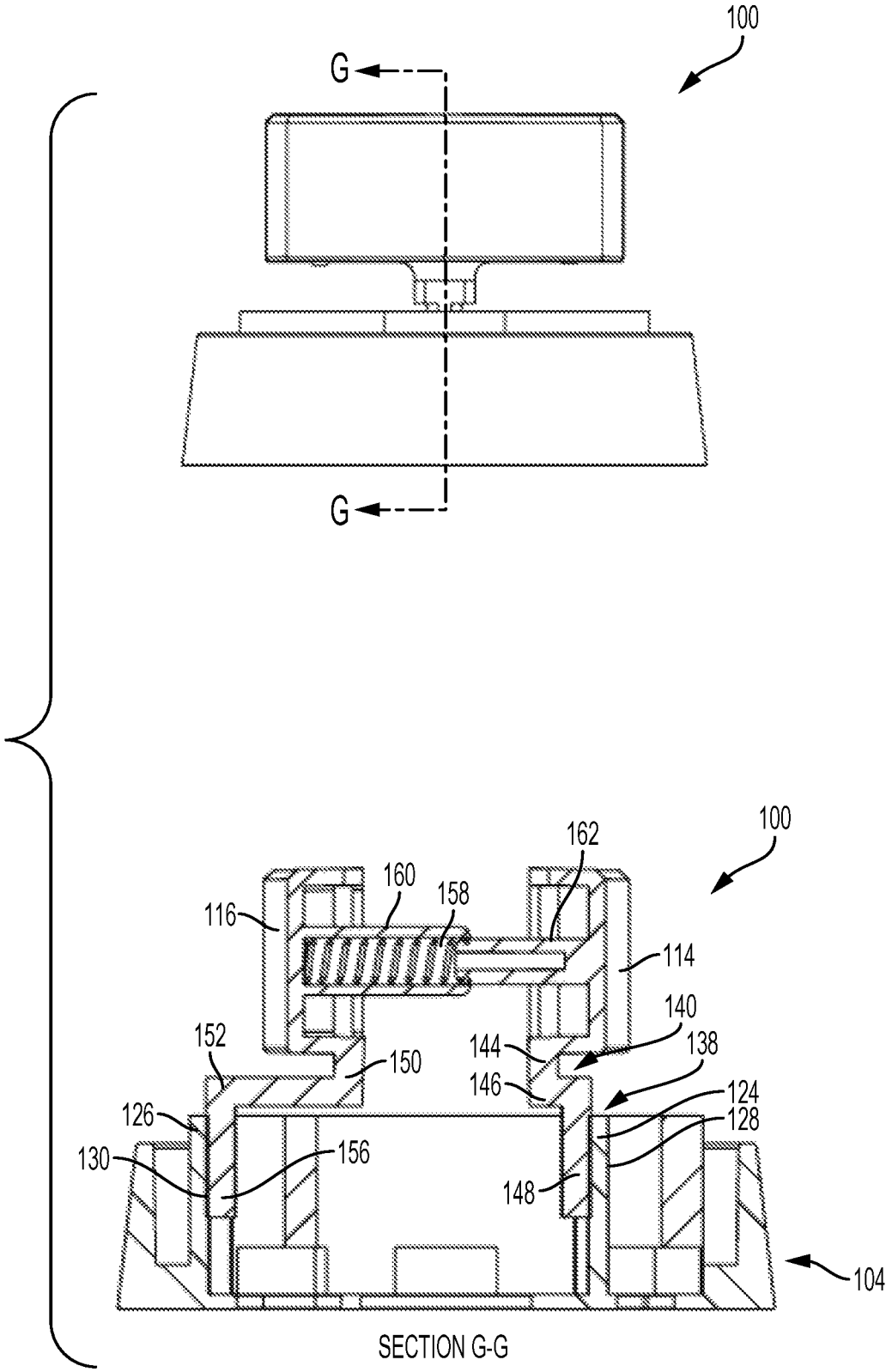
FIG. 5 illustrates a partial cross sectional view of the automatic locking knob assembly taken along section line G-G. This view does not include the adapter or the valve stem.

Referring now to FIGS. 2 and 5 collectively illustrate the locking sub-assembly 108. In general, the locking sub-assembly 108 comprises the first button 114, the second button 116, and a resilient coupler (e.g. a spring 158).

The first button 114 comprises a first leg 140 that is configured to mate with the first pillar 124 when the knob 102 is in a locked position. The second button 116 comprises a second leg 142 that is configured to mate with the second pillar 126 when the knob 102 is in a locked position.

The first leg 140 is configured to operate within the first track sidewall 132 and the second leg 142 is configured to operate within the second track sidewall 134. As mentioned above, the first track sidewall 132 fits within the second track sidewall 134. To compensate for disparate sizing (e.g., diameters) of the first and second track sidewalls 132 and 134, the first leg 140 and the second leg 142 are sized differently from one another. In some embodiments, the first leg 140 extends downwardly from the first button 114 with a first vertical section 144, which angles into a horizontal transition section 146, which extends perpendicularly from the first vertical section 144. The first leg 140 also comprises a second vertical section 148 that is offset from the first vertical section 144 by the horizontal transition section 146. A length of the horizontal transition section 146 allows the second vertical section 148 to translate along an inner portion of the first track sidewall 132 when the knob 102 is rotated.

In some embodiments, the second leg 142 extends downwardly from the second button 116 with a first vertical section 150, which angles into a horizontal transition section 152, which extends perpendicularly from the first vertical section 150. The second leg 142 comprises a second vertical section 156 that is offset from the first vertical section 150 by the horizontal transition section 152. A length of the horizontal transition section 152 allows the second vertical section 156 to translate along an inner portion of the second track sidewall 134 when the knob 102 is rotated.

To be sure, the horizontal transition section 152 of the second leg 142 is longer in length than the horizontal transition section 146 of the first leg 140. Again, this difference in size between the horizontal transition section 152 of the second leg 142 and the horizontal transition section 146 of the first leg 140 is due to the difference in diameter of the first track sidewall 132 and the second track sidewall 134.

When the knob 102 is in a locked configuration (e.g., the "off" position of the valve stem 14), as illustrated in FIGS. 2 and 5, the second vertical section 148 of the first leg 140 mates within the first groove 128 of the first pillar 124. Also, the second vertical section 156 of the second leg 142 mates within the second groove 130 of the second pillar 126.

In some embodiments, the first button 114 and the second button 116 are resiliently biased by a spring 158. In one embodiment, the second button 116 comprises a cylinder 160 that houses the spring 158. The first button 114 comprises a plunger 162 that functions to compress the spring 158 with the cylinder 160 when the first and second buttons 114 and 116 are depressed.

In operation, if the knob 102 in the locked configuration, the user can utilize the knob 102 to turn the valve stem 14 by depressing both the first and second buttons 114 and 116 simultaneously, which causes the plunger 162 to compress the spring 158 bringing the first leg 140 and the second leg 142 towards one another and into engagement with the adapter 106. In some embodiments, the first vertical section 144 of the first leg 140 contacts the adapter 106 and the first vertical section 150 of the second leg 142 contacts the adapter 106. To be sure, the right angles formed by each of the first and second legs 140 and 142 fit into shoulder sections 164 and 166 of the adapter 106.

Stated otherwise, the first vertical section 144 of the first leg 140 and the first vertical section 150 of the second leg 142 exert lateral forces on the adapter 106 in a direction that is normal to a central axis C of the valve stem 14.

In general, the adapter 106 has a sidewall with a profile. Each of the first leg 140 and the second leg 142 have a shape that is complementary to the profile such that they can mate with the profile of the sidewall of the adapter 106 when the first and second legs (140, 142) are brought into contact with the adapter 106.

Movement of the first and second buttons (114, 116) towards one another functions to disassociate the first leg 140 from the first groove 128 of the first pillar 124 and the second leg 142 from the second groove 130 of the second pillar 126. The first leg 140 is free to rotate around the first track sidewall 132 and the second leg 142 is free to rotate around the second track sidewall 134 as long as the first and second buttons 114 and 116 are depressed and/or the knob 102 is in any position other than the locked position.

If the knob 102 is rotated back to the locked position, the first leg 140 will lock back into the first groove 128 of the first pillar 124 and the second leg 142 will lock back into the second groove 130 of the second pillar 126. To be sure, when the first and second buttons 114 and 116 are released by the user the spring 158 will push the first and second buttons away from one another, which ensures that the first leg 140 will stay within the first groove 128 of the first pillar 124 and the second leg 142 will stay within the second groove 130 of the second pillar 126 when the knob 102 is in the locked position. The resilient biasing of the first and second buttons 114 and 116 causes the assembly 100 to automatically lock when the knob 102 is in the locked position.

Figure 6:
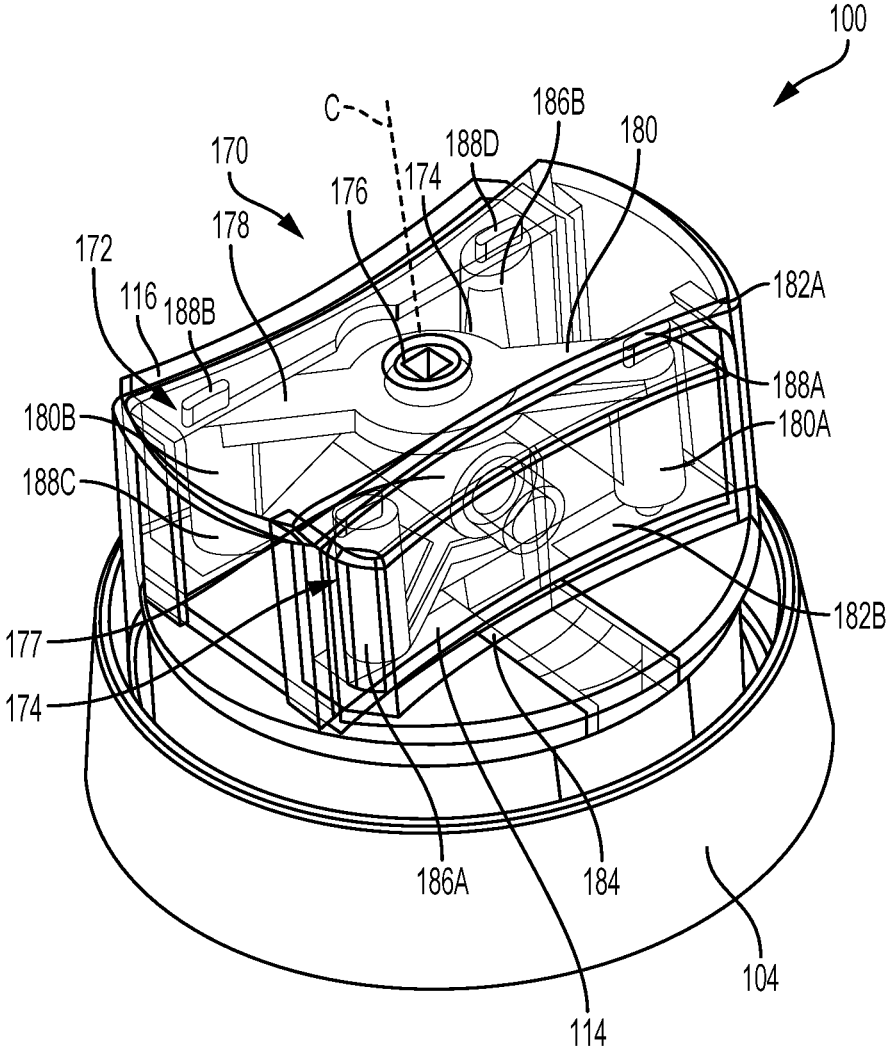
FIG. 6 is a perspective view of the automatic locking knob assembly illustrating a pair of struts that control movement of a pair of buttons.
Figure 7:
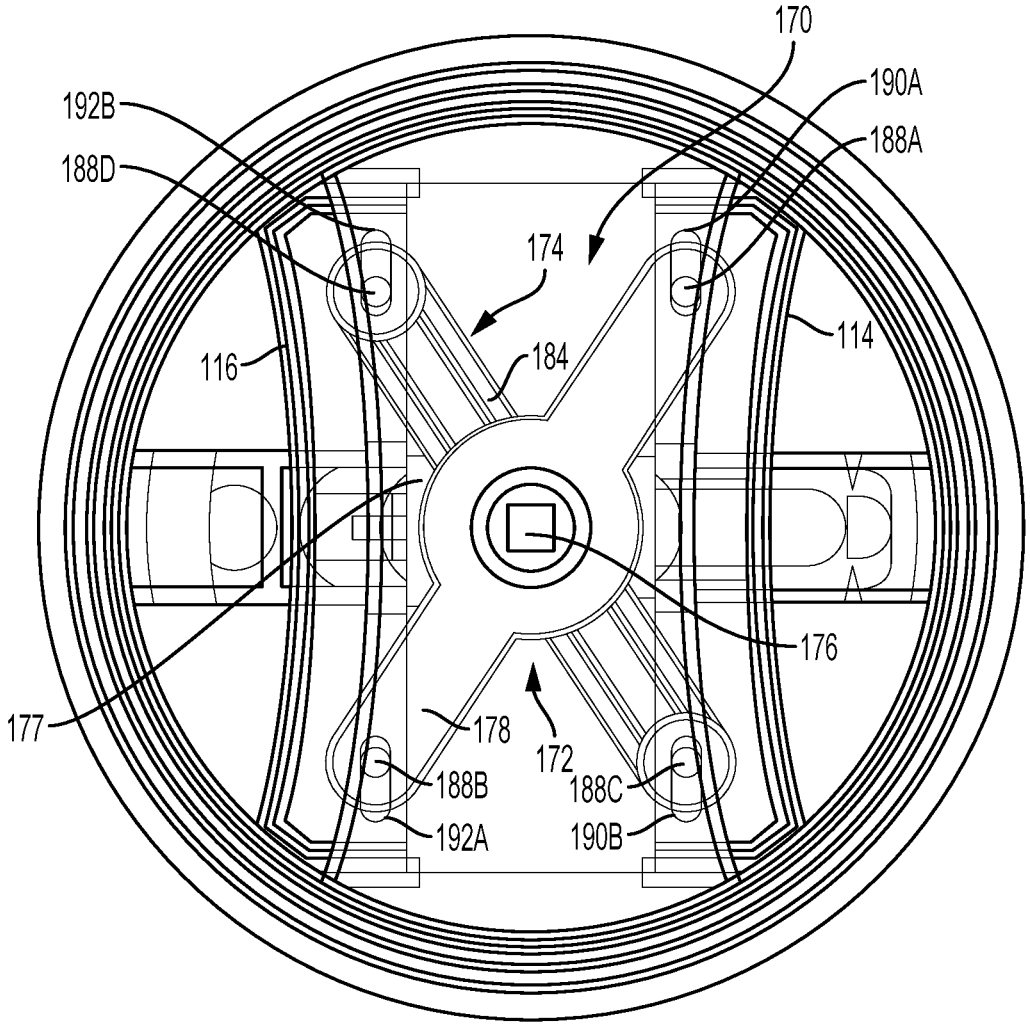
FIG. 7 is a top down view of FIG. 6 illustrating a positioning of the pair of struts when the automatic locking knob assembly is in a locked position.

Referring now to FIGS. 6 and 7 collectively, an example strut sub-assembly 170 is illustrated. The strut sub-assembly 170 is configured to cooperate with the locking sub-assembly 108 (FIGS. 2 and 5) to provide for controlled movement of the first and second buttons 114 and 116 from their extended positions to their depressed positions. To be sure, the strut sub-assembly 170 is optional in some embodiments.

The strut sub-assembly 170 comprises a first strut 172, a second strut 174, and a shaft 176. The first strut 172 comprises a strut body 178 and a pair of tubular pin supports 180A and 180B. In some embodiments, the pair of tubular pin supports 180A and 180B are sized to span an interior portion of the first and second buttons 114 and 116. For example, tubular pin support 180A is sized to fit between an upper surface 182A of the first button 114 and a lower surface 182B of the first button 114. The second button 116 has a shape that is similar to that of the first button 114.

Similarly, the second strut 174 comprises a strut body 184 and a pair of tubular pin supports 186A and 186B.

In some embodiments both the first strut 172 and the second strut 174 are rotatably coupled to the shaft 176. Also, the shaft 176 extends along the central axis C of the adapter 106.

The shaft 176 can be coupled with a barrel 177 that houses the cylinder 160. In some embodiments, the shaft 176 is divided into two portions where a first portion of the shaft 176 extends from a top of the barrel 177 and a second portion of the shaft 176 extends below the barrel 177.

In one embodiment the first strut 172 is coupled to the first portion of the shaft 176 above the barrel 177 and the second strut 174 is coupled to the second portion of the shaft 176 below the barrel 177. The tubular pin supports 180A and 180B of the first strut 172 are positioned to point downwardly while the tubular pin supports 186A and 186B point upwardly.

In some embodiments, the strut sub-assembly 170 employs pins which connect the struts 172 and 174 to the buttons 114 and 116, allowing the struts 172 and 174 to pivotally and laterally move relative to the first and second buttons 114 and 116.

For example, tubular pin support 180A is coupled to the first button 114 with pin 188A. Tubular pin support 180B is coupled to the second button 116 with pin 188B. Similarly, tubular pin support 186A is coupled to the first button 114 with pin 188C. Tubular pin support 186B is coupled to the second button 116 with pin 188D.

In some embodiments, the first button 114 is provided with slots 190A and 190B, which receive ends of pins 188A and 188C, respectively. The second button 116 is provided with slots 192A and 192B, which receive ends of pins 188B and 188D, respectively. The pins can travel within the slots to allow the struts 172 and 174 to not only pivot and rotate about the shaft 176, but also provide for some lateral/linear movement of the struts 172 and 174 to accommodate for slight differences in pressure exerted on the buttons 114 and 116 by the user. That is, the slots provide for smooth pivoting and rotating motion of the struts 172 and 174, which when combined allows the struts 172 and 174 to move in an arcuate pattern, which is advantageous for rounded knob configurations.

When installed, the struts (172, 174) form a substantially X-shaped pattern. When the buttons (114, 116) are depressed by the user the struts (172, 174) the X-shaped pattern begins to close. For example, tubular pin support 180A will move towards tubular pin support 186B and tubular pin support 180B will move towards tubular pin support 186A. As tubular pin supports approach each other, the tubular pin supports will also traverse to their outermost position within the slots (providing the arcuate motion described above).

Figure 8:
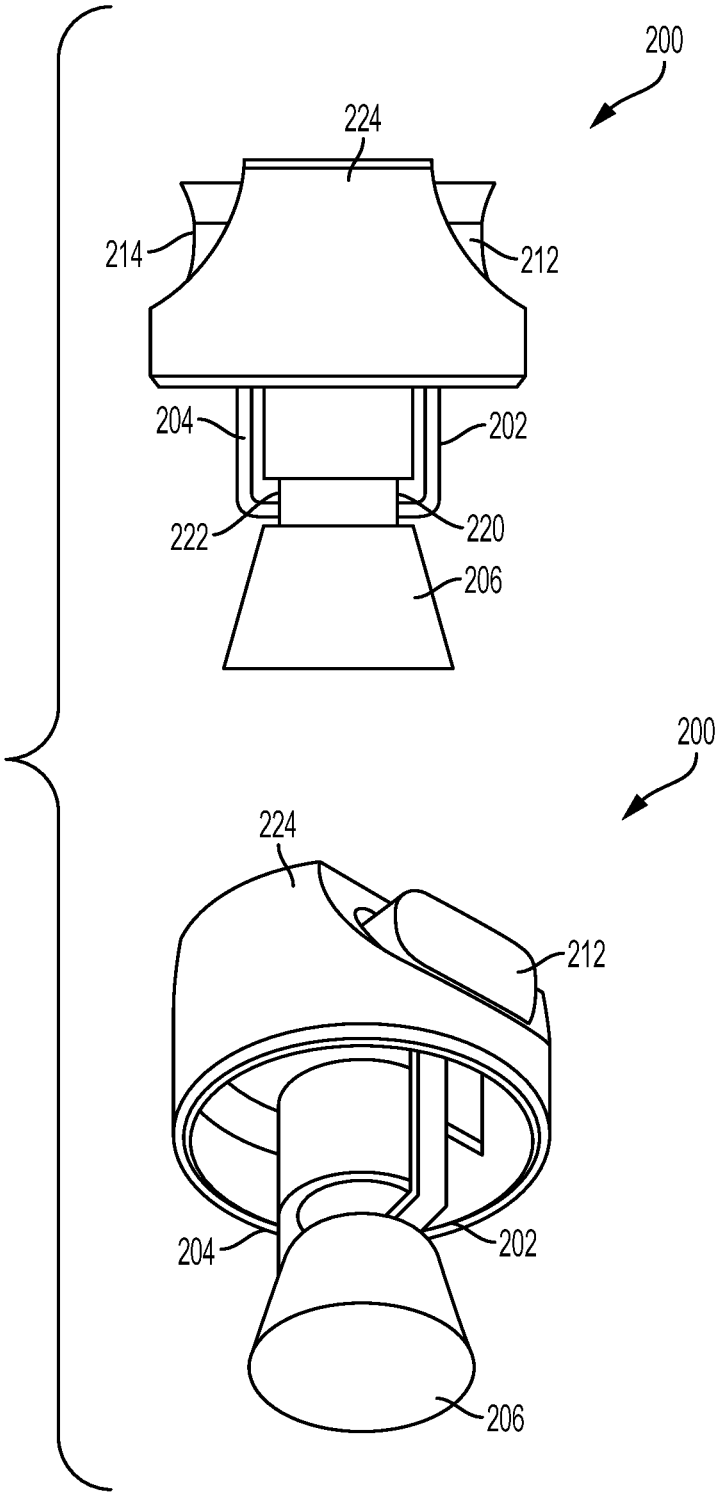
FIG. 8 illustrates both a front elevation view of another example automatic locking knob assembly as well as a perspective view of the example automatic locking knob assembly.
Figure 9:
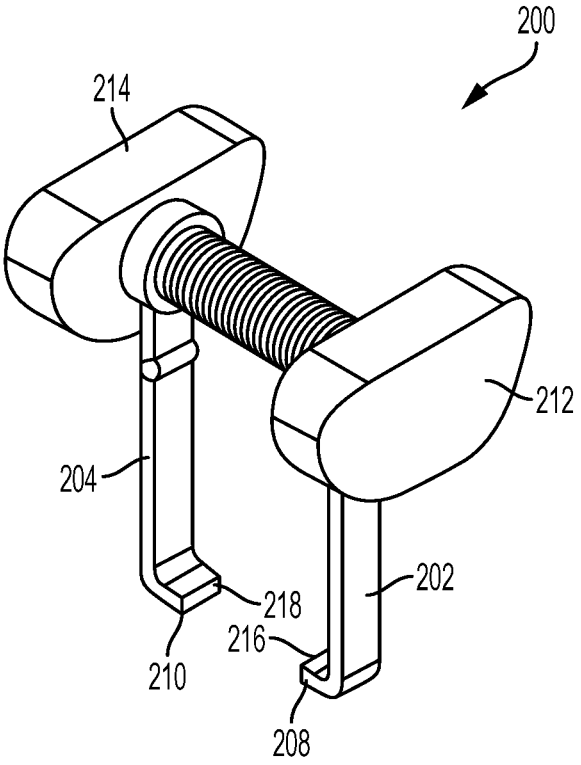
FIG. 9 is a perspective view of the locking sub-assembly of the embodiment of FIG. 8.

Another alternative embodiments of locking-sub assemblies are provided in FIGS. 8 and 9, which will be described in the collective. In this embodiment, a automatic locking knob assembly 200 comprises a pair of legs 202 and 204 that are configured to exert lateral forces on an adapter 206. Each of the pair of legs 202 and 204 comprise a perpendicularly extending section, such as sections 208 and 210, which press onto the adapter 206 when the buttons 212 and 214 are depressed. In some embodiments, ends 216 and 218 of sections 208 and 210 are substantially flat. These ends 216 and 218 are configured to mate flush with flat surfaces 220 and 222 of the adapter 206. This flush mating configuration allows the ends 216 and 218 to maintain contact with the adapter 206 as the knob 224 is turned, while the buttons 212 and 214 are depressed simultaneously.

Figure 10:
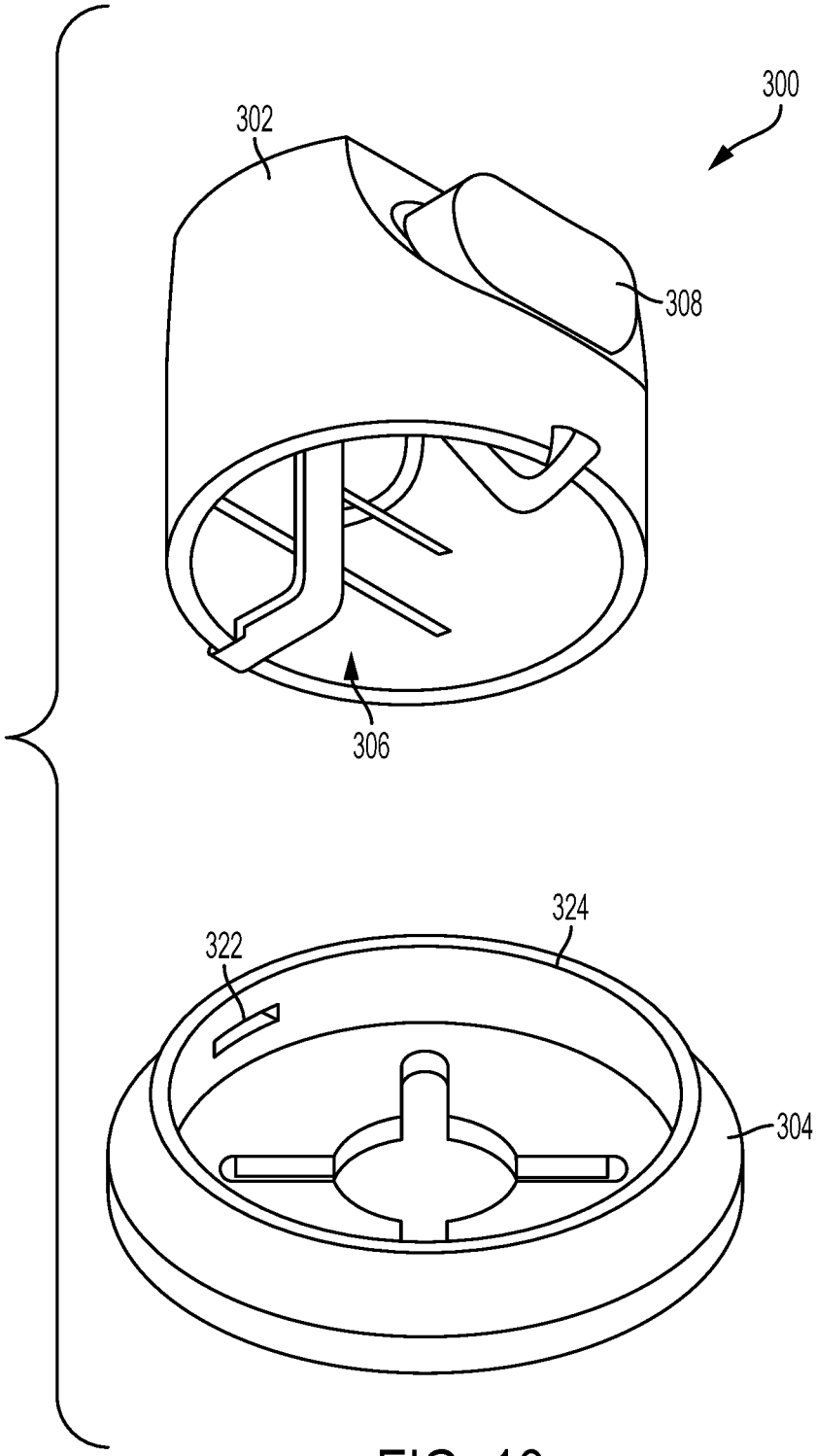
FIG. 10 illustrates both a partial perspective view of another example automatic locking knob assembly as well as a perspective view of a base of the automatic locking knob assembly.
Figure 11:
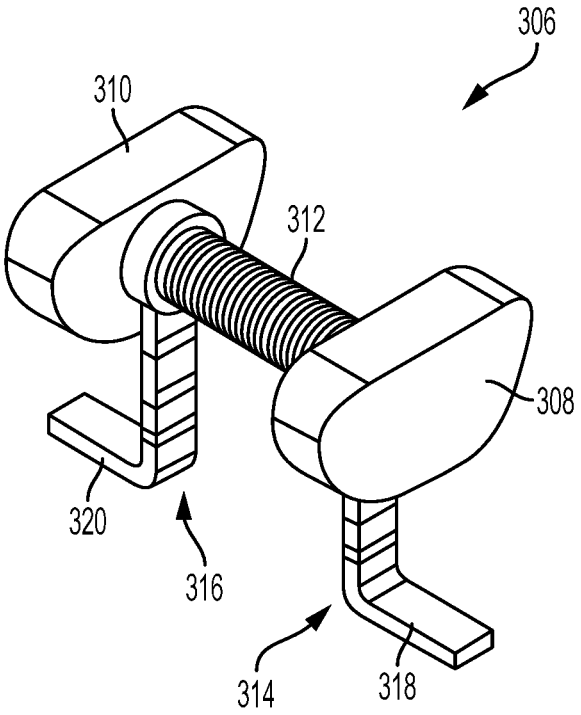
FIG. 11 is a perspective view of an example locking sub-assembly of the automatic locking knob assembly of FIG. 10.

Referring now to FIGS. 10 and 11 illustrate another example automatic locking knob assembly 300 that comprises knob 302, a base 304, and a locking sub-assembly 306.

The knob 302 is configured to house a first button 308 and a second button 310, which are part of the locking sub-assembly 306. As with other embodiments, the first and second buttons 308 and 310 are held in spaced apart relationship and resiliently coupled with a spring 312. Each of the first button 308 and the second button 310 include a leg. For example, the first button 308 comprises a first leg 314 and the second button 310 comprises a second leg 316. In contrast with the embodiment of FIGS. 8 and 9, the first and second legs 314 and 316 comprise outwardly extending sections 318 and 320. The outwardly extending sections 318 and 320 are configured for insertion within slots, such as slot 322 provided into an outer peripheral sidewall 324 of the base 304. While not shown, a second slot is disposed on an opposing side of the outer peripheral sidewall 324.

It will be understood that in alternative embodiments, the outer peripheral sidewall 324 may comprise only one slot and the locking sub-assembly 306 can include only one of the legs (either the first or second) having an outwardly extending section. Thus, in these embodiments the assembly 300 can be reduced to having a single button for engaging and disassociating a leg with a slot in the outer peripheral sidewall 324.

As with the other embodiments, depression of the button causes the leg associated with the button to disassociate with the slot allowing the knob 302 to freely rotate. In embodiments where two buttons and two legs are employed, the legs are configured to contact the adapter and turn a valve stem of a stove (as shown in FIG. 2). In yet other embodiments, the assembly 300 can employ two buttons, each with legs, while only one of the legs comprises an outwardly extending section for contacting one or more slots in the outer peripheral sidewall 324 of the base 304.

Figure 12:
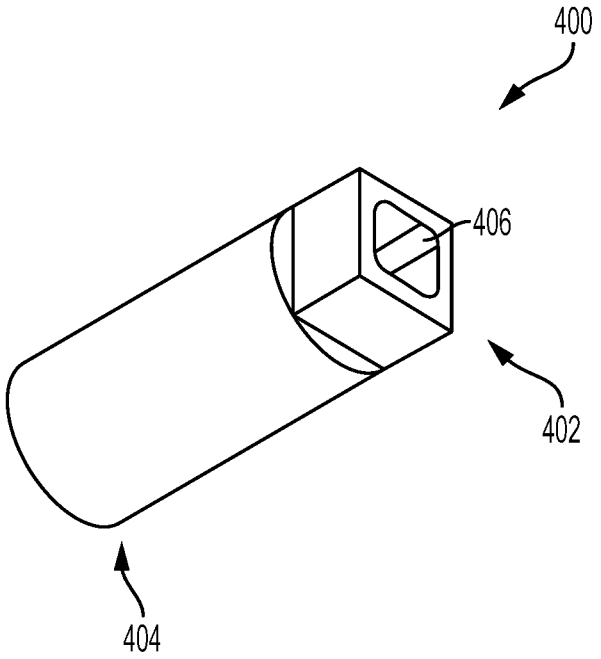
FIG. 12 is a perspective view of an example adapter for use with automatic locking knob assemblies of the present technology.

FIG. 12 illustrates an example adapter 400 for use in accordance with the present technology. This adapter 400 can be utilized in any of the embodiments described above which require an adapter.

In some embodiments, the adapter 400 can comprise a polygonal section 402 and a tubular section 404. The adapter 400 is tubular and comprises an aperture 406 for receiving a valve stem of a stove, as illustrated best in FIG. 2. The polygonal section 402 can comprise a rectangle, a square (as illustrated), a triangle, an irregular polygon, and so forth. To be sure, the shape of the sidewalls of the polygonal section 402 are configured to mate with the legs (or ends of legs) of buttons of a locking sub-assembly, as described in various embodiments above.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel, or may be performed at different times.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. An automatic locking knob assembly, comprising:
a knob;
a base configured to mount to a stove surface of a stove, the base comprising two pillars disposed in a spaced apart relationship to one another;
an adapter configured to mate with a valve stem of the stove extending through the base; and
a locking sub-assembly, comprising:
a first button comprising a first leg;
a second button comprising a second leg, the first leg and the second leg being resiliently coupled to one another;
the first leg and the second leg being configured to place the knob in a locked position; and
wherein simultaneous depression of the first and second button cause the knob to freely rotate as well as the first and second legs to contact the adapter and turn the valve stem.

2. The assembly according to claim 1, wherein the first button and the second button are disposed on opposing sides of the knob and depression of the first and second buttons causes the first leg and the second leg to contact the adapter and impart forces perpendicular to a central axis of the adapter.

3. The assembly according to claim 1, wherein the first leg comprises a tab that extends perpendicularly and the second leg comprises a tab that extend perpendicularly.

4. The assembly according to claim 3, wherein the adapter has a rectangular shaped sidewall and the tabs contact the rectangular shaped sidewall to allow for turning of the adapter based on turning of the knob.

5. The assembly according to claim 1, wherein the base comprises a first track sidewall and a second track sidewall, the first leg traversing the first track sidewall and the second leg traversing the second track sidewall when the knob is rotated.

6. The assembly according to claim 5, wherein the first track sidewall and the second track sidewall are arranged as concentric circles such that the first track sidewall is disposed within the second track sidewall.

7. The assembly according to claim 1, wherein the adapter has a sidewall with a profile, further wherein each of the first leg and the second leg comprising a shape so as to mate with the profile of the sidewall of the adapter when the first and second legs are brought into contact with the adapter.

8. The assembly according to claim 1, wherein the adapter comprises a polygonal section, the first leg and the second leg contacting the polygonal section, the adapter further comprising a tubular section extending from the polygonal section.

9. The assembly according to claim 1, further comprising a first strut extending between the first button and the second button, wherein the first strut is rotationally connected to a central shaft aligned with a central axis of the assembly.

10. The assembly according to claim 9, further comprising a second strut extending between the first button and the second button, wherein the second strut is rotationally connected to the central shaft aligned with the central axis of the assembly.

11. The assembly according to claim 10, wherein the first button comprises a pair of slots that receive pins which pivotally couple a first end of the first strut to the first button and a first end of the second strut to the first button.

12. The assembly according to claim 11, wherein the second button comprises a pair of slots that receive pins which pivotally couple a second end of the first strut to the second button and a second end of the second strut to the second button.

13. The assembly according to claim 12, further comprising a barrel which receives a spring that resiliently couples the first button and the second button.

14. The assembly according to claim 13, wherein the first strut is disposed on top of the barrel and the second strut is below the barrel.

15. An automatic locking knob assembly, comprising:
a knob;
a base configured to mount to a stove surface of a stove, the base comprising a sidewall that comprises at least one slot;
an adapter configured to mate with a valve stem of the stove extending through the base; and
a locking sub-assembly, comprising:
at least one button;
a first leg, the first leg being configured to mate with the at least one slot to place the knob in a locked position, wherein when the knob is in the locked position the valve stem is in an off position; and
wherein depression of the at least one button causes the knob to freely rotate as well as the first leg and a second leg to contact the adapter and turn the valve stem, the second leg being a separate structural element from the first leg.

16. The assembly according to claim 15, further comprising a second button, the second button extending at least partially from the knob.

17. The assembly according to claim 16, further comprising a second slot in the base for receiving the second leg.

* * * * *